United States Patent [19]

Sorlien et al.

[11] Patent Number: 4,561,708

[45] Date of Patent: Dec. 31, 1985

[54] CABLE SHIELD CONNECTOR

[75] Inventors: Mark D. Sorlien, White Bear Lake; Manuel Filreis, Edina, both of Minn.

[73] Assignee: Minnesota Mining and Manufacturing Company, St. Paul, Minn.

[21] Appl. No.: 615,299

[22] Filed: May 30, 1984

[51] Int. Cl.[4] ..... H01R 4/66

[52] U.S. Cl. ..... 339/14 L; 339/95 R

[58] Field of Search ..... 174/84 R, 88, 78; 339/14 R, 14 L, 96, 97, 263, 95 R

[56] References Cited

U.S. PATENT DOCUMENTS

| | | | |
|---|---|---|---|
| Re. 28,468 | 7/1975 | Baumgartner et al. | 339/14 L |
| 3,676,836 | 7/1972 | Gillemot et al. | 339/97 R |
| 3,701,839 | 10/1972 | Smith | 174/78 |
| 3,778,749 | 12/1973 | Kapell | 339/97 R |
| 3,787,797 | 1/1974 | Kurz | 339/95 R |
| 3,915,540 | 10/1975 | Thompson et al. | 339/95 R |
| 4,140,870 | 1/1979 | Volkers et al. | 174/78 |
| 4,176,893 | 12/1979 | Olszewski et al. | 339/14 R |
| 4,291,934 | 9/1981 | Kund | 339/95 R |
| 4,310,209 | 1/1982 | Fleming et al. | 339/14 R |
| 4,325,598 | 4/1982 | Leonardo | 339/14 L |
| 4,353,612 | 10/1982 | Meyers | 339/95 R |

*Primary Examiner*—Eugene F. Desmond

*Attorney, Agent, or Firm*—Donald M. Sell; James A. Smith; David W. Anderson

[57] ABSTRACT

A shield connector is provided for use with a telephone cable having a central core of individual conductors, a metallic sheath surrounding the central core, and a polymeric sheath encapsulating the shield which offers high initial contact force, a long travel in spring action, and resistance to high amperage currents. The connector includes an inner shoe inserted between the shield and the core conductors, an outer shoe overlying the cable sheath and clampingly engaged with the inner shoe by means of a threaded stud interconnecting the inner and outer shoes through a slit provided in the shield and the sheath, and a tang extending from one of the inner or outer shoes to contact the other of the inner or outer shoes exteriorly of the shield and the sheath. The inner shoe includes sloped transverse sides which interact with pointed, sheath-piercing prongs provided on the outer shoe to force the prongs outwardly and to increase the curvature of the inner shoe upon clamping engagement of the inner and outer shoes to store energy in the shoes and compensate for cold flow of the sheath and shield disposed between the shoes.

19 Claims, 7 Drawing Figures

CABLE SHIELD CONNECTOR

BACKGROUND OF THE INVENTION

1. Field of the Invention

This invention relates to a cable shield electrical connector used one on each side of a communications cable splice to provide electrical continuity of a cable shield across the splice as well as to mechanically connect the shield of a cable to the shields of secondary cables, grounded service wires or other grounding devices.

2. Description of the Prior Art

Telephone cable systems normally include a plurality of discrete cable lengths which are joined together at splice locations or which are joined to other apparatus at terminal points. Each of these discrete cable lengths comprises a multi-conductor core which is enclosed in a metallic shield and an outer plastic sheath. The electrical shield normally takes the form of a polyethylene-coated, corrugated cylinder, usually a good conductor such as aluminum, which forms a tubular member interposed between the conductors and the cable sheath.

A metallic shield in a telephone cable performs a variety of important functions. Some of these are protection of installers from injury and equipment from damage if a live power line should contact the cable, protection from induced current from power lines, protection from currents resulting from lighting, and suppression of radio frequency interference. The metallic shield also provides physical protection of the cable core and acts as a barrier to moisture penetration.

To obtain effective shielding from power line induced noise, for example, shield continuity and earth grounding must be provided throughout the cable. At splice locations, where the cable sheath and shield are removed to expose the individual conductors, it is necessary to provide for continuity of the shield across the splice for proper electrical protection of the conductors. Moreover, it is necessary that the cable shield be earth grounded. Connection to the cable shield at splice locations and its terminal ends is generally accomplished with a shield connector which may be referred to in the art as a bond clamp or bonding connector.

Investigation of many presently available cable shield connectors reveals that contact resistance between the connector and the shield increases substantially with time and, as a result, telephone companies have experienced noisy lines. The increase in contact resistance has been attributed to loss of contact between the connector and the shield, which results in oxidation of the shield at the contact points. Aluminum, as well as the cable sheath, which is normally a low density polyethylene, have the tendency to relax by cold flow or creep under sustained load, and, in addition, the dimensional stability of the sheath is very sensitive to temperature fluctuations. Therefore, dissipation of the initially applied pressure at the contact points between the connector and shield takes place with time and aluminum oxide forms which is non-conductive and consequently results in increased electrical resistance between the connector and the shield.

This difficulty in achieving adequate electrical contact to the cable shield has recently been complicated by the provision of a secondary, polyethylene-coated steel shield between the aluminum shield and the cable sheath. This cable is known as a coated aluminum, coated steel, polyethylene (CACSP) cable, with the steel shield being provided primarily to protect the cable from physical damage. It is, however, required that continuity of the steel shield be maintained and that the steel shield be electrically connected to the aluminum shield at splice points to ensure that a voltage potential never exists between the two shields and to provide an additional conductive path for high amperage currents such as results from lightning strikes.

Some shield connectors have an inherent spring reserve to press the contact elements together and compensate for cold flow in the shield and the sheath, thereby minimizing the increase in contact resistance with age. These connectors generally fall into two categories, which include the cantilever types and the direct force types. The cantilever types have pivoting top and bottom plates capturing an end portion of the sheath and shield which are pulled together by joining means, usually a bolt, external to the contact area, i.e., between the pivot and the contact area. Examples are the connectors of U.S. Pat. Nos. 3,778,749 and 3,787,797. The direct force types are the most common and include a centrally located joining means pulling top and bottom plates together in the contact area. In this case the joining means passes through a hole or slit in the sheath. Examples are the connectors of U.S. Pat. Nos. 3,676,836 and 3,701,839.

The cantilever type of connector has the advantage of a potentially large travel and spring reserve. Its primary disadvantage is lower initial contact force, typically one-half the tension in the joining means. The direct force type of connector provides initial contact force approximately equal to the tension in the joining means, but it has a small potential travel stored in the resiliency of the connector and, therefore, does not compensate for cold flow of the cable sheath very well.

In view of these problems with existing shield connectors, design criteria for an improved shield connector might include high initial contact force together with a long travel provided by a spring reserve which maintains low electrical contact resistance independent of cold flow of the sheath material.

In addition to failures caused by increased contact resistance, fault currents and lightning surge currents also have been known to cause shield connector failures by melting the joining means, usually a threaded stud, pulling the top and bottom plates together in the contact area. Another design criteria for an improved shield connector is that the connector should be highly resistant to these damaging currents.

Finally, an improved shield connector must provide a strong mechanical grip on the cable and be resistant to forces which would tend to disturb contact integrity or pull the connector free of the cable shield and sheath.

SUMMARY OF THE INVENTION

A shield connector which provides high initial contact force, a long travel to compensate for shield cold flow, resistance to pull-out, and resistance to high amperage currents is provided in accordance with the principles of this invention by a connector which includes a metallic inner shoe inserted between the shield and the core conductors, a metallic outer shoe overlying the cable sheath, a threaded stud interconnecting the inner and outer shoes through a slit provided in the shield and the sheath, and a tang extending from one of the inner or outer shoes to contact the other of the inner or outer shoes beyond the ends of the shield and the sheath.

In the preferred embodiment, the inner shoe includes a flat body portion adapted to be inserted between the shield and the core conductors, which body portion has an integral stud projecting perpendicularly from the upper surface of the inner shoe and through a slit provided in the cable shield and sheath. Each longitudinal edge of the inner shoe body portion is provided with a radially inwardly angled or curved dependent skirt which is adapted to conform to the shape of the shield. The dependent skirts are in turn provided with outwardly struck barbs projecting toward the shield and adapted to penetrate the polyethylene coating of the shield and contact the conductor portion of the shield.

The outer shoe includes a flat main portion substantially corresponding to the length and width of the body portion of the inner shoe and which includes a central hole receiving the stud supported on the inner shoe. Depending from each longitudinal edge of the outer shoe main portion are prongs which pierce the cable sheath parallel to the stud to contact the outer surface of the aluminum shield or the outer surface of an overlying steel shield, if the cable is so provided. A nut is threaded on the inner shoe stud and tightened to clamp the outer shoe to the outer surface of the cable sheath and force the outer shoe prongs into engagement with the skirts of the inner shoe with the aluminum shield or the aluminum and steel shields interposed therebetween. Engagement of the outer and inner shoes causes the inner shoe skirts to be biased inwardly and the outer shoe prongs to be biased outwardly, thus storing energy which allows the prongs and skirts to travel with a spring action and compensate for plastic flow of the shield.

Each of the inner and outer shoe includes an end which projects beyond the ends of the shield and the sheath, one of which is provided with a tang projecting axially to contact the other and provide a parallel current carrying path in addition to the paths provided by the stud connecting the inner and outer shoes and the barbs and points which directly contact the shield or shields.

BRIEF DESCRIPTION OF THE DRAWINGS

The present invention will be more thoroughly described with reference to the accompanying drawings wherein like numbers refer to like parts in the several views, and wherein.

DESCRIPTION OF THE PREFERRED EMBODIMENT

Figure 1:
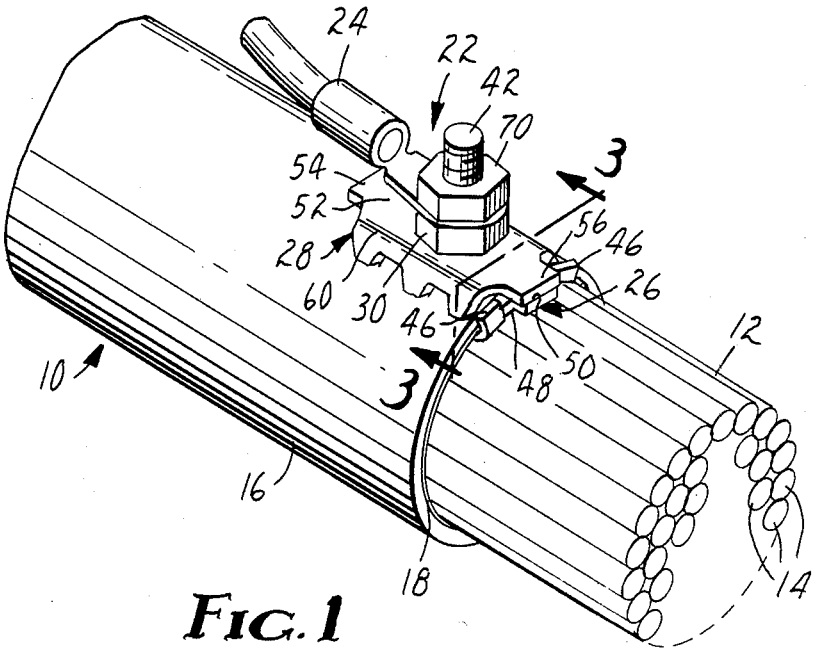
FIG. 1 is a perspective view of a distribution cable and a cable shield connector according to the present invention assembled thereto.

Referring to the drawings, and in particular FIG. 1, there is shown a communication cable, generally indicated as 10, which consists of a central core 12 of individually insulated conductors 14, an outer insulating sheath 16, and a metallic shield 18 interposed between the core conductors 14 and the outer sheath 16.

Figure 4:
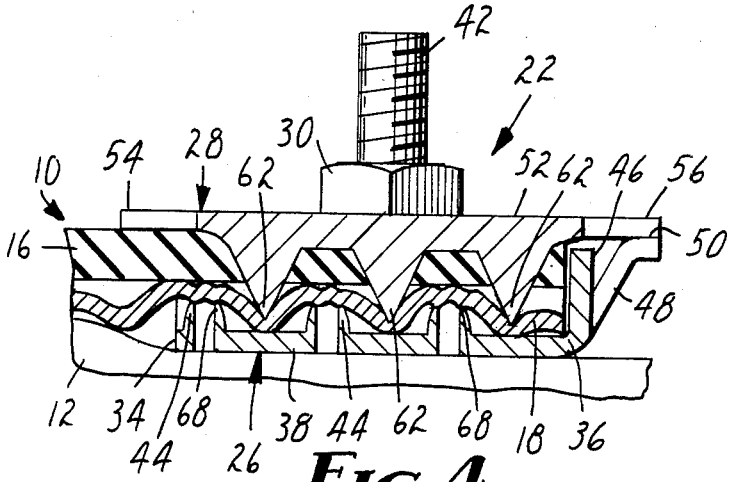
FIG. 4 is an enlarged, cross-sectional view of the cable shield connector of FIG. 1 and a portion of the distribution cable taken generally along the line 4—4 of FIG. 3.
Figure 3:
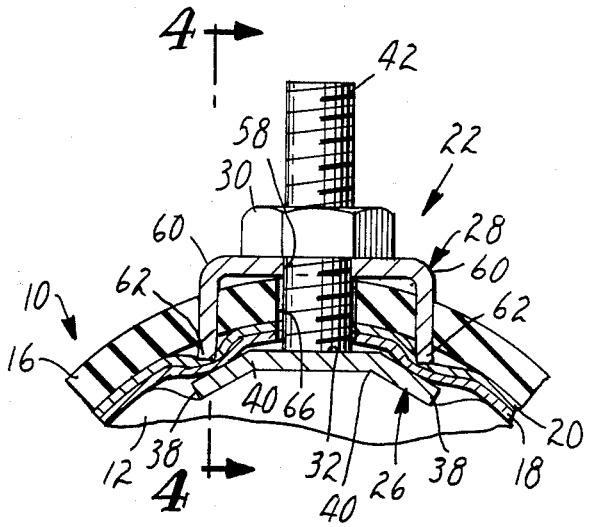
FIG. 3 is an enlarged, partial cross-sectional view of the cable and connector of FIG. 1 taken generally along the line 3—3 of FIG. 1.

The shield 18 is often manufactured of aluminum to provide a low resistance current path and is typically corrugated along the length of the cable 10 to aid in cable flexibility. The shield 18 is usually covered on both sides with a thin polymer coating (not shown), usually polyethylene, which aids in the prevention of oxidation of the shield 18 and entry of water to the core 12. In the most usual construction of the cable 10 only one shield 18 is provided as shown in FIGS. 1 and 4. The cable 10 may, however, be provided with a second metallic shield 20, as shown in FIG. 3, positioned between the inner aluminum shield 18 and the sheath 16. This second shield 20 is usually steel or polyethylene-coated steel and is provided to increase protection of the cable 10 from abrasion, cutting, and gnawing animals. Although the connector to be described herein may be effectively used with either single or double shielded cables, for simplicity reference will generally be made only to a single shield.

When discrete lengths of the cable 10 must be spliced, or when the cable 10 is terminated, it is necessary to provide for electrical continuity of the aluminum shield 18. It is also necessary to provide for the electrical continuity of the second steel shield 20, if used, in order to prevent a voltage potential between the shields 18 and 20 and to provide a secondary current conducting path for high currents such as those caused by faults or lightning strikes.

Electrical continuity of the shield 18 is provided according to the present invention by a cable shield connector, generally indicated as 22. The connector 22 clampingly engages the sheath 16 and the shield 18 and is connected to a secondary conductor 24 which is in turn connected to either another connector 22 attached to a next length of cable 10 or a grounding point.

Figure 2:
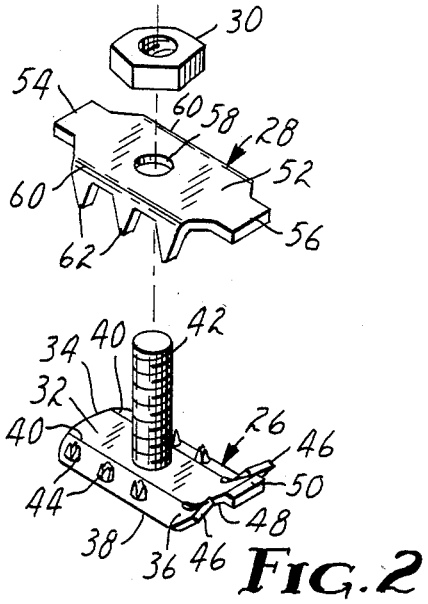
FIG. 2 is an exploded perspective view of the cable shield connector of FIG. 1.

As best seen in FIG. 2, the cable shield connector 22 includes an inner shoe 26, an outer shoe 28, and a threaded nut 30. The inner shoe 26 is generally concave with respect to the core 12 of the cable 10, and includes in the preferred embodiment a flat, rectangular central portion 32 which includes a leading end 34 adapted for insertion between the central core 12 and the cable shield 18, a trailing end 36 which extends beyond the ends of the cable sheath 16 and the cable shield 18, two flat, rectangular skirts 38 which depend from each longitudinal edge 40 of the central portion 32 at an angle of approximately 35 degrees, and a threaded stud 42 which projects perpendicularly from a position approximately midway between the leading end 34 and the trailing end 36 of the central portion 32.

The dependent skirts 38 further include radially outwardly struck barbs 44 which are adapted to penetrate the polymer coating of the shield 18 and contact the metal comprising the shield 18, and outwardly projecting stops 46 which contact the first to be encountered of the ends of the sheath 16 or the shield 18 to limit insertion of the inner shoe 26 and ensure that the inner shoe 26 is longitudinally aligned with the cable 10.

As illustrated in FIGS. 2 and 4, the barbs 44 are preferably formed by piercing the material of the skirts 38 with a tool having a circular or diamond shaped point. Such piercing results in four pointed barbs 44 at each location. While this structure is preferred, the barbs 44 could be formed in a variety of shapes, such as triangular or rectangular as shown in U.S. Pat. Nos. 4,310,209 or 3,915,540, so long as a sharp edge is produced which will adequately penetrate the coating of the shield 18.

The trailing end 36 of the inner shoe 26 includes an upwardly formed tang 48 which terminates in a contact surface 50 spaced above the central portion 32 of the inner shoe 26 a distance sufficient to contact the outer shoe 28 when the inner shoe 26 and the outer shoe 28 are assembled to the cable 10. Although the tang 48 is illustrated as extending from the inner shoe 26 to contact the outer shoe 28, it should be understood that the tang 48 could effectively extend from the outer shoe 28 radially inwardly to contact the trailing end 36 of the inner shoe 26.

The outer shoe 28 includes a flat, rectangular main body 52 which generally corresponds to the central portion 32 of the inner shoe 26 and which has a leading end 54 overlying the cable sheath 16 and a trailing end 56 extending beyond the ends of the cable sheath 16 and shield 18. Centrally located in the main body 52 is a stud-receiving hole 58. Dependent at approximately 90 degrees from the transverse edges 60 of the main body 52 are longitudinally spaced pointed prongs 62 which are adapted to pierce the cable sheath 16 parallel to the stud 42 and contact the outer surface of the cable shield 18. The prongs 62 are spaced to lie between the barbs 44 formed on the skirts 38 of the inner shoe 26 and not interfere with these barbs 44. The trailing end 56 of the main body 52 engages the contact surface 50 of the inner shoe tang 48 and the ends 54 and 56 and the prongs 62 are symmetrical so that the outer shoe 28 may be reversed to facilitate assembly.

The material used to form the inner and outer shoes 26 and 28 is preferably brass or bronze, which may be tin plated, to provide a good electrical conductivity between the shoes 26 and 28 and the aluminum shield 18. In addition, the inner and outer shoes 26 and 28 are preferably hardened to provide resiliency of the material for a reason to be explained later. Although both the inner and outer shoes 26 and 28 are preferably manufactured of brass or bronze, the outer shoe 28 may be of steel to increase the strength of the prongs 62 and ensure they are not deflected as they penetrate the cable sheath 16.

Assembly of the connector 22 to the cable 10, and contact between the inner and outer shoes 26 and 28 and the cable shield 18, will be described with reference to FIGS. 3 and 4. Assembly is accomplished by cutting the sheath 16 and the shield 18 to form a slit 66 extending approximately one inch (25 mm) from the ends of the sheath 16 and the shield 18. The slit 66 is enlarged by lifting the corners of the sheath 16 and the shield 18 adjacent the slit 66 a distance sufficient for the insertion of the threaded stud 42 of the inner shoe 26. The inner shoe 26 is inserted between the shield 18 and the central core 12 until either or both of the ends of the sheath 16 and the shield 18 are contacted by the stops 46 provided at the trailing end 36 of the skirts 38 dependent from the central portion 32 of the inner shoe 26. The stops 46 not only prevent further insertion of the inner shoe 26 along the cable 10 but also ensure that the inner shoe 26 is properly longitudinally aligned with the length of the cable 10.

After the inner shoe 26 has been inserted into the cable 10, the outer shoe 28 is assembled to the stud 42 of the inner shoe 26 by means of the hole 58 which is placed over the stud 42. Assembly and tightening of the nut 30 to the threaded stud 42 forces the outer shoe 28 downwardly to cause the prongs 62 to penetrate the sheath 16 and draws the inner shoe 26 radially outwardly away from the central core 12 of the cable 10 to bring the barbs 44 into contact with the inner surface of the shield 18. As is best seen in FIG. 4, the prongs 62 force the shield 18 into contact with the dependent skirts 38 of the inner shoe 26 and provide electrical contact between the outer shoe 28 and the outer surface of the shield 18. Further tightening of the nut 30 on the threaded stud 42 causes the prongs 62 to be forced transversely outwardly because of the slanted configuration of the dependent skirts 38. The resiliency of the inner shoe 26 and the outer shoe 28 may be predetermined by the thicknesses of the inner shoe 26 and the outer shoe 28, taking into consideration the characteristics of the material, so that the inner shoe 26 is forced into an increasingly concave configuration with respect to the central core 12 of the cable 10 as the prongs 62 of the outer shoe 38 are forced transversely outward. This resilient deformation of the inner shoe 26 and the outer shoe 28 stores energy in these members which causes the inner shoe 26 and the outer shoe 28 to remain in clamping engagement even though the material comprising the shield 18 or the sheath 16 may relax or cold flow as the cable 10 ages.

As best seen in FIG. 4, contact with the inner surface of the shield 18 is accomplished by the barbs 44 projecting from the dependent skirts 38 of the inner shoe 26 in a manner similar to the contact accomplished between the prongs 62 of the outer shoe 28 and the outer surface of the shield 18. The edges 68 of the barbs 44 are sufficiently sharp to penetrate the polymer coating of the shield 18 and ensure electrical contact between the metallic material of the shield 18 and the inner shoe 26. Thus, clamping of the outer shoe 28 to the inner shoe 26 provides direct electrical contact between the outer shoe 28 and either the outer surface of a single shield 18 or the outer surface of the second steel shield 20 while direct electrical contact is provided between the inner shoe 26 and the inner surface of a single shield 18 or the inner surface of the innermost shield 18 if the cable 10 is provided with two shields 18 and 20.

Electrical contact between the inner shoe 26 and the outer shoe 28 is provided by the threaded stud 42, which is directly attached to the inner shoe 26, and the nut 30 which contacts the threaded stud 42 and the outer surface of the main body 52 of the outer shoe 28. Also, direct electrical contact is provided between the inner shoe 26 and the outer shoe 28 by means of the contact surface 50 of the inner shoe 26 which is brought into the contact with the trailing end 56 of the outer shoe 28. This contact between the contact surface 50 and the trailing end 56 provides a parallel conductive path between the inner and outer shoes 26 and 28 and helps prevent melting of the stud 42 in the event high fault currents or lightning strikes are encountered. Thus the current carrying capacity of the connector 22 is greatly increased. Current conducted from the shield 18 or the shields 18 and 20 to the connector 22 are carried from the connector 22 by means of the secondary conductor 24 which is connected to the threaded stud 42 by means of a second nut 70 as illustrated in FIG. 1.

Figure 5:
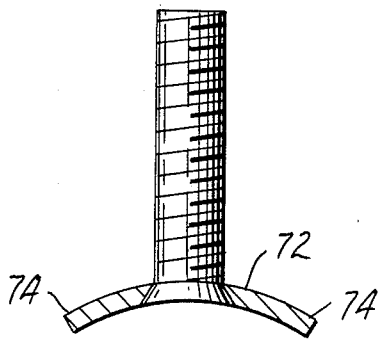
FIGS. 5, 6 and 7 are transverse, cross-sectional views of alternate embodiments of a portion of the cable connector adapted to be inserted in the cable.
Figure 6:
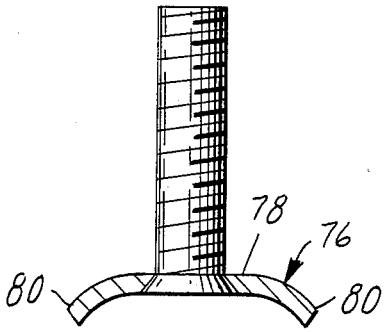
Figure 7:
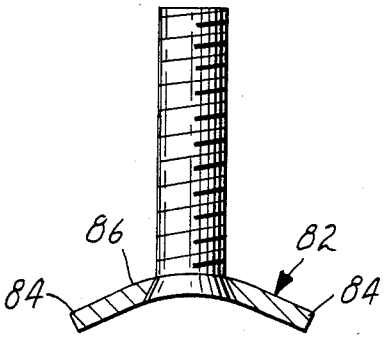

FIGS. 5, 6 and 7 illustrate alternate embodiments the inner shoe 26 may assume and still function as described above. It is necessary that the inner shoe 26 be easily inserted between the central core 12 and the shield 18 of the cable 10 and that the inner shoe 26 provide a properly sloped surface adjacent its longitudinal edges which will cause the prongs 62 of the outer shoe to be forced outwardly and which will cause the inner shoe 26 to be resiliently forced into an increasingly concave configuration with respect to the core 12. As illustrated by FIGS. 5–7, these functions of the inner shoe may be accomplished by various cross-sectional configurations. In FIG. 5, the central portion 72 assumes a transversely curved shape rather than the flat shape shown in FIGS. 1–4. This transverse curvature of the central portion 72 substantially matches the radius of the shield 18 and may facilitate insertion of the central portion 72 between the shield 18 and the core 12. FIG. 5 also illustrates that the dependent skirts 74 connected to the transverse edges of the central portion 72 may be curved rather than straight, and may form an extension of the central portion 72. The slope of the portion of the upper surface of the skirts 74 contacted by the prongs 62, however, must be equal to the slope of the skirts 38 of FIGS. 1–4 in order that the prongs 62 of the outer shoe 28 are forced transversely outwardly by contact with the dependent skirts 74.

FIG. 6 illustrates an embodment of an inner shoe 76 in which the central portion 78 is flat, as in FIGS. 1–4, but in which the dependent skirts 80 are curved as in FIG. 5 rather than flat as in FIGS. 1–4.

Finally, FIG. 7 illustrates an inner shoe 82 in which the dependent skirts 84 are straight as in the inner shoe 26 of FIGS. 1–4 but wherein the central portion 86 of the inner shoe 82 is curved as the central portion 72 of the inner shoe of FIG. 5. FIGS. 5–7 illustrate that the inner shoe may assume a variety of configurations so long as the dependent skirts are properly oriented to transversely force the prongs 62 of the outer shoe 28 outwardly. Although the struck barbs 44 of FIGS. 1–4 are not illustrated in FIGS. 5–7, it is to be understood that any of the inner shoes of FIGS. 5–7 are to be provided with such barbs.

A connector 22 has been described which provides electrical contact to both the inner and outer surfaces of a single cable shield or to both shields of a cable provided with a double layer of shields. Thus the shield 18 or the shields 18 and 20 are electrically connected directly to the inner shoe 26 and the outer shoe 28 by the barbs 44 and the prongs 62, respectively, and the shoes 26 and 28 are interconnected by the threaded stud 42. Also, a parallel connection is provided between the shoes 26 and 28 by the tang 48 which reduces the current which must be carried by the stud 42 and will permit the stud 42 to be manufactured from a higher resistivity but more durable and stronger material, such as steel or stainless steel, than the high conductivity brass or bronze used for the shoes 26 and 28.

In addition to providing direct contact between the outer shoe 28 and the shield 18, the prongs 62 provide a reserve of travel in resilient spring action by deflecting outwardly and by causing the inner shoe 26 to deflect into a more concave configuration. This reserve of travel is used to compensate for cold flow of the polyethylene sheath 16 and the shield 18 and ensure continuing contact between the connector 22 and the shield 18. The prongs 62 also serve to reduce cold flow of the sheath 16 because the inner and outer shoes 26 and 28 bear directly on each other rather than compressing greatly the sheath 16 as is done in the prior art. Penetration of the prongs 62 completely through the sheath 16 not only reduces the dependency upon the material of the sheath 16 for continuing contact but also reduces the tendency of the connector 22 to pull free from the cable 10 when subject to external forces.

Although the present invention has been described with reference to relatively few embodiments, modifications will be apparent to those skilled in the art. The invention is intended to cover all such modifications falling within the scope of the appended claims.

We claim:

1. A connector adapted for attachment to a cylindrical cable having an outer protective polymer sheath and at least one underlying metallic shield enclosing a core of conductors which extend beyond the ends of the protective sheath and the shield, the sheath and shield being slit longitudinally of the cable, the connector comprising:

a resilient, electrically conductive inner shoe having a leading end for insertion between said shield and said core, a trailing end extending beyond the ends of said shield and said sheath, longitudinal edges connecting said inner shoe leading and trailing ends, a threaded stud disposed approximately midway between said leading and trailing ends and extending from said inner shoe and through said slit, and at least one radially outwardly struck barb adjacent each inner shoe longitudinal edge, said inner shoe being longitudinally flat between said leading and trailing ends and transversely concave with respect to said core;

a resilient, electrically conductive outer shoe overlying said sheath and having a substantially flat, rectangular body longitudinally aligned with the length of the cable and including a stud receiving hole, a leading end, a trailing end extending beyond the ends of said sheath and said shield, longitudinal edges connecting said outer shoe leading and trailing ends, and at least one pointed, sheath-piercing prong depending parallel to said stud from each longitudinal edge of said body portion to straddle said slit; and a nut threaded on said stud and drawing said inner and outer shoes into clamping engagement with said shield and said sheath so that said outer shoe prongs penetrate said sheath to contact said shield adjacent said sheath and said inner shoe barbs contact said shield adjacent said core, said prongs and said barbs being respectively disposed along said longitudinal edges of said outer and inner shoes to preclude opposite contact of said barbs and said prongs with said shield;

the resiliency of said inner and outer shoes being such that said concavity of said inner shoe is increased by contact with said outer shoe prongs through said shield and said outer shoe prongs are forced transversely outward by contact with said inner shoe through said shield so that energy is stored in said shoes to maintain said outer shoe prongs and said inner shoe barbs in contact with said shield despite compressive relaxation of said shield and independently of compressive relaxation of said sheath interposed therebetween.

2. A connector according to claim 1 further including a tang extending from one of said trailing ends of said inner or outer shoes to contact the other of said trailing ends of said inner or outer shoes to provide a current bypass path between said inner and outer shoes.

3. A connector according to claim 1 further including at least one stop extending radially outward from said inner shoe with respect to said cable core to contact the first encountered of the ends of said shield or said sheath to limit insertion of said inner shoe between said core and said shield.

4. A connector according to claim 1 wherein said inner shoe comprises a longitudinally flat, transversely curved central portion and skirts, upon which said barbs are disposed, dependent from each longitudinal edge of said central portion the curvature of said central portion being substantially the same as that of said shield.

5. A connector according to claim 4 wherein said skirts are transversely curved with a curvature substantially equal to that of either said shield or said central portion.

6. A connector according to claim 4 wherein said skirts are longitudinally and transversely flat and are angled with respect to said central portion at approximately 35 degrees.

7. A connector according to claim 1 wherein said inner shoe comprises a longitudinally and transversely flat central portion and skirts, upon which are disposed said barbs, dependent from each longitudinal edge of said central portion, said skirts substantially conforming to the curvature of said shield.

8. A connector according to claim 7 wherein said skirts are transversely curved with a curvature substantially equal to that of said shield.

9. A connector according to claim 7 wherein said skirts are longitudinally and transversely flat and are angled with respect to said central portion at approximately 35 degrees.

10. A connector kit for attachment to an end of a cable comprising an outer protective polymer sheath and an underlying conductive and generally cylindrical shield supporting a plurality of conductors extending beyond the end of the sheath and the shield and the sheath and the shield having a cut therein extending axially from said end thereof, the connector kit comprising:

a resilient, electrically conductive inner shoe having a generally longitudinally flat body portion with parallel longitudinal edges connecting a leading end for insertion between said conductors and said shield and a trailing end, skirts extending from said longitudinal edges which diverge from said body portion, said skirts having outwardly projecting barb means for contacting said shield, and a threaded stud supported on said body portion symmetrically with respect to said barb means;

a resilient, electrically conductive outer shoe having a generally planar body portion with longitudinal edges joining a leading end adapted to overlie said sheath and a trailing end, said longitudinal edges of said outer shoe being spaced a greater distance than the edges of said inner shoe, pointed prong means depending from said outer shoe longitudinal edges and generally perpendicular to said body portion for piercing said sheath and contacting said shield, said prong means extending toward said diverging skirts of said inner shoe as said outer shoe overlies said inner shoe and said body portion of said outer shoe being formed with a hole positioned symmetrically with said prong means for receiving said threaded stud; and a threaded nut to receive said stud and draw said inner and outer shoes together into clamping engagement to urge said prong means into engagement with said inner shoe with said prong means penetrating said sheath and forcing said shield interposed therebetween against said skirts and said barb means as said prong means are forced transversely outward and said skirts of said inner shoe are biased toward each other.

11. A connector kit according to claim 10 further including a tang extending from one of said trailing ends of said inner or outer shoes to contact the other of said trailing ends of said inner or outer shoes and provide a current bypass path between said inner and outer shoes when said inner and outer shoes are in clamping engagement.

12. A connector kit according to claim 10 further including at least one stop extending outward from said inner shoe to contact the first encountered of the ends of said shield or said sheath and thereby limit insertion of said inner shoe between said conductors and said shield.

13. A connector kit according to claim 10 wherein said inner shoe comprises a central portion which is longitudinally flat and transversely curved with substantially the same curvature as that of said shield.

14. A connector kit according to claim 13 wherein said skirts are transversely curved with a curvature substantially equal to that of either said shield or said central portion.

15. A connector kit according to claim 13 wherein said skirts are planar and are angled with respect to a chord connecting said longitudinal edges of said central portion at approximately 35 degrees.

16. A connector kit according to claim 10 wherein said inner shoe comprises a planar central portion and wherein said skirts substantially conform to the curvature of said shield.

17. A connector kit according to claim 16 wherein said skirts are transversely curved with a curvature substantially equal to that of said shield.

18. A connector kit according to claim 16 wherein said skirts are planar and are angled with respect to said central portion at approximately 35 degrees.

19. A connector kit according to claim 10 wherein said prongs are disposed relative to said stud receiving hole and said barbs are disposed relative to said stud to preclude engagement between said prongs and said barbs when said inner and outer shoes are drawn into clamping engagement.

* * * * *